US006672622B2

(12) United States Patent
Barron

(10) Patent No.: US 6,672,622 B2
(45) Date of Patent: Jan. 6, 2004

(54) PROTECTIVE NOTEPAD HOLDER

(76) Inventor: Jack Barron, 11 Sadie Hutt La., Southborough, MA (US) 01772

( * ) Notice: Subject to any disclaimer, the term of this patent is extended or adjusted under 35 U.S.C. 154(b) by 42 days.

(21) Appl. No.: 10/013,000

(22) Filed: Nov. 13, 2001

(65) Prior Publication Data

US 2003/0091381 A1 May 15, 2003

(51) Int. Cl.[7] ..... B42D 17/00

(52) U.S. Cl. ..... 281/44; 281/45; 281/51; 462/72; 224/277

(58) Field of Search ..... 281/15.1, 21.1, 281/29, 44, 45, 51; 402/70, 73, 4; 462/71, 72; 206/557; 224/277

(56) References Cited

U.S. PATENT DOCUMENTS

| | | | | | |
|---|---|---|---|---|---|
| 1,642,385 | A | | 9/1927 | Pryor | |
| 1,967,632 | A | | 7/1934 | Simonson | |
| 2,547,167 | A | | 4/1951 | Nielsen | |
| 2,806,715 | A | * | 9/1957 | Smith | 281/44 |
| 2,907,584 | A | * | 10/1959 | Neilsen | 281/44 |
| 3,977,744 | A | | 8/1976 | DeWitt | |
| 4,294,558 | A | | 10/1981 | Errichiello | |
| D261,903 | S | | 11/1981 | Mulder | |
| 4,445,728 | A | | 5/1984 | Bratton | |
| 4,484,830 | A | | 11/1984 | Anderson | |
| 4,630,769 | A | | 12/1986 | Ball | |
| 4,832,369 | A | | 5/1989 | Johnson et al. | |
| 4,919,037 | A | | 4/1990 | Mitchell | |
| 4,969,068 | A | * | 11/1990 | Williams | 206/472 |
| 4,997,088 | A | | 3/1991 | Spry | |
| 5,000,327 | A | | 3/1991 | Kincheloe | |
| D324,399 | S | | 3/1992 | Murphy | |
| 5,137,453 | A | * | 8/1992 | Hudson | 434/408 |
| 5,351,818 | A | | 10/1994 | Daneshvar | |
| 5,474,333 | A | | 12/1995 | Schrader | |
| 5,555,671 | A | | 9/1996 | Voight et al. | |
| 5,590,910 | A | | 1/1997 | Meth | |
| 5,671,951 | A | | 9/1997 | Palmiter et al. | |
| D398,650 | S | | 9/1998 | Shamoon | |
| D428,927 | S | | 8/2000 | Chang | |
| 6,213,669 | B1 | | 4/2001 | Yamamoto | |
| 6,302,563 | B1 | * | 10/2001 | Yama | 362/253 |

OTHER PUBLICATIONS

Shoplet.com. Snapak Aluminum Forms Holder Available website: http://www.shoplet.com/office/cgi–bin/node.xgi?url=/office/db//SAU10519.html printed on: Aug. 31, 2001.

Shoplet.com. Style–A Forms Aluminum Forms Holder Available website: http://www.shoplet.com/office/cgi–bin/node.xgi?url=/office/db//SAU10007.html Printed on: Aug. 31, 2001.

Shoplet.com. Slide–Rite Plastic Storage Box with Clipboard. Available website: http://www.shoplet.com/office/cgi–bin/node.xgi?url=/office/db//SAU21575.html Printed on: Aug. 31, 2001.

Shoplet.com. Redi–Rite Aluminum Clipboard/Forms Holder.
Available website: http://www.shoplet.com/office/cgi–bin/node.xgi?url=/office/db//SAU11017.html Printed on: Aug. 31, 2001.

Staples.com. Storage Clipboard. Available website: http://www.staples.com/Catalog/Browse/SKU.asp?BCFlag=False&PageType=1&SKU=NEW10764 Printed on: Aug. 30, 2001.

Staples.com. Dexas Clipcase, Clear. Available website: http://www.staples.com/Catalog/Browse/SKU.asp?BC-Flag=False&PageType=1&SKU=390993 Printed on: Aug. 30, 2001.

Saunders Office Products Company Slide–Rite and Work-Box Available website: http://www.saunders–usa.com/clipboard_plastic.html Printed on: Aug. 31, 2001.

WeatherWriter.com. WeatherWriter. Available website: http://www.weatherwriter.com/weatherwriter/products/wwriter/wwriter.htm Printed on: Aug. 30, 2001.

* cited by examiner

*Primary Examiner*—Willmon Fridie, Jr.
(74) *Attorney, Agent, or Firm*—Wolf, Greenfield & Sacks, P.C.

(57) ABSTRACT

A protective notepad cover that encloses a notepad to protect it from splashed water and other elements in one position and allows access to the notepad for writing in another position.

23 Claims, 5 Drawing Sheets

PROTECTIVE NOTEPAD HOLDER

BACKGROUND OF THE INVENTION

There exists in the prior art an abundance of protective notepad holders that enclose a notepad within a box shaped structure to protect it from the elements. However, most of this prior art is designed such that the notepad must be removed from the protective enclosure and placed outside of it before the notepad can be written upon. In fact, much of the prior art includes a notepad holder, such as a clamp fixed to the outside of the protective enclosure to help hold the notepad to the exterior or such holders.

Products also exists in the prior art that protect a notepad from the elements while allowing access to the notepad for the purpose of writing or reading. One of such products is described in U.S. Pat. No. 2,547,167 ('167) for an all weather recording board. However, among other short comings, the product identified in the '167 patent has no provisions to prevent water from entering the interior of the enclosure at the seam between the top covering and the tray structure on which the notepad is located. Furthermore, the product is designed such that water can pool on the top surface of the top covering. Additionally, the top covering is hingedly connected to the tray structure which may prevent its complete removal if such is desired.

Other patents including U.S. Pat. Nos. 5,590,910; 5,474,333; 4,997,088; 4,445,728; and 1,642,385 disclose protective coverings that shield a notepad from the elements. However, among other short comings, these devices fail to completely enclose a notepad which leaves the notepad susceptible to windblown rain, splashed water or other elements.

SUMMARY OF THE INVENTION

Embodiments of aspects of the present invention provide an improved apparatus for protecting a notepad from splashed liquid and other outdoor elements that might damage the notepad.

One illustrative embodiment of the invention provides a tray structure having a base panel, and a tray side panel that are adapted to receive a notepad. It also provides a covering structure with a top panel and a covering side panel. The covering structure is completely separable from the tray structure whereby removing the covering structure gives access to the notepad and replacing the covering structure prevents splashed liquid from reaching the notepad. Furthermore, the covering structure is shaped to prevent water from pooling on the top panel when the covering structure is placed on the tray structure with the base panel in a horizontal position.

In another illustrative embodiment of the invention, tool free fasteners are provided to removably fasten a notepad holder to a mounting surface. The notepad holder comprising a tray structure adapted to receive a notepad, and a covering structure adapted to mate with the tray structure to enclose the notepad within the tray structure and the covering structure.

In yet another illustrative embodiment of the invention, a notepad holder comprising a tray structure having a base panel and a covering structure having a top panel is provided. In this embodiment, the tray is adapted to receive the notepad and the covering structure is adapted to be separable from the tray structure whereby separating the covering structure from the tray structure allows access to the notepad and replacing the covering structure prevents splashed liquid from reaching the notepad, and prevents access to the notepad. Furthermore, the covering structure is shaped to prevent water from pooling on the top panel when it is placed on the tray structure with the base panel in a horizontal position. In such a position, a side panel that is disposed between the tray structure and the covering structure serves to enclose the sides of the notepad.

Further features and advantages of the present invention, as well as the structure and operation of various embodiments of the present invention are described in detail below with reference to the accompanying drawings.

BRIEF DESCRIPTION OF THE DRAWINGS

The invention is described with reference to the following drawings, in which similar reference numbers indicate similar structures.

DETAILED DESCRIPTION

Figure 2:
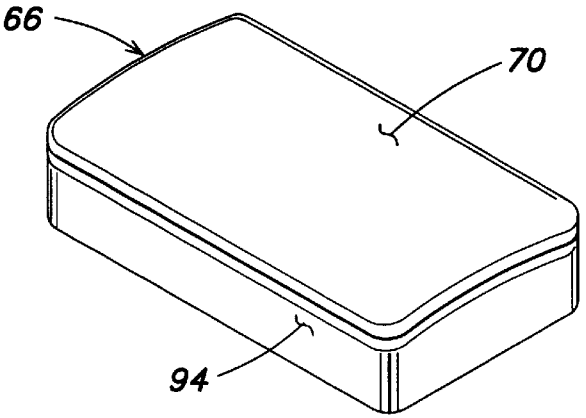
FIG. 2 is a perspective view of another embodiment of a covering structure.

The present invention will be better understood upon reading the following detailed description of various embodiments of aspects thereof in connection with the drawings.

The notepad holder 50 shown in the drawings is used to completely enclose a notepad 54, notebook, loose leaf paper, etc. to protect the notepad or similar from the elements, including but not limited to windblown rain or splashed water. The notepad holder 50 is designed to be used on a flat mounting surface 102 in an outdoor environment such as on a table near a swimming pool, on an outdoor picnic table, or in any other environment where a notepad 54 might be desired and there is concern of splashed liquid or other outdoor elements damaging the notepad 54.

The notepad holder 50 has a tray structure 58 with at least a base panel 62 and a covering structure 66 with at least a top panel 70. Both the tray 58 and the covering 66 are designed to cooperatively engage in at least two positions. The first position is a closed position where the notepad 54 is completely enclosed within the notepad holder 50 and thus protected from splashed water and the elements. The second position is an open position that provides access to the notepad 54 such that a user can read from the pad 54 or write on the pad 54. In some embodiments, the covering 66 is made of a clear material such that the pad 54 can be read from when the holder 50 is oriented in either position.

Figure 1:
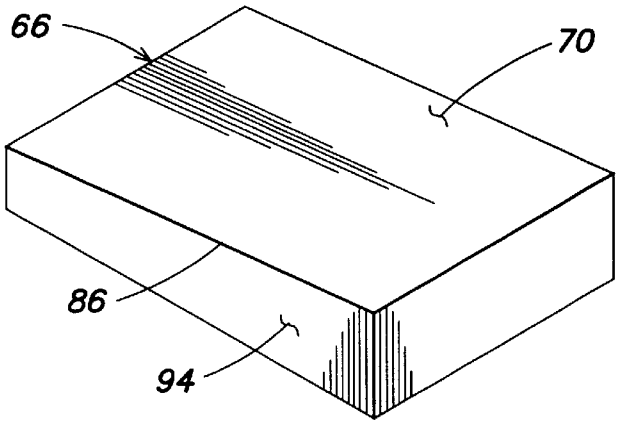
FIG. 1 is a perspective view of an embodiment of a covering structure.
Figure 6:
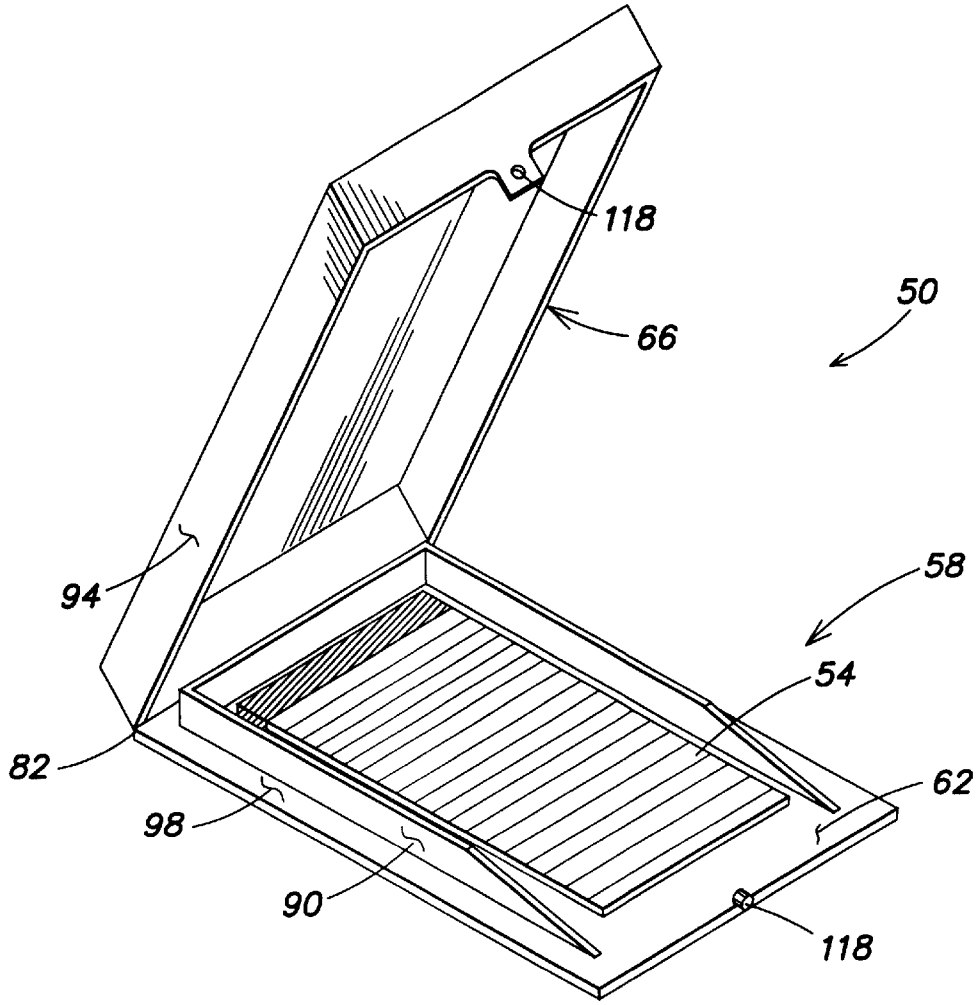
FIG. 6 is a perspective view of an embodiment of the protective notepad holder that has a pivotally connected covering structure and tray structure.
Figure 13:
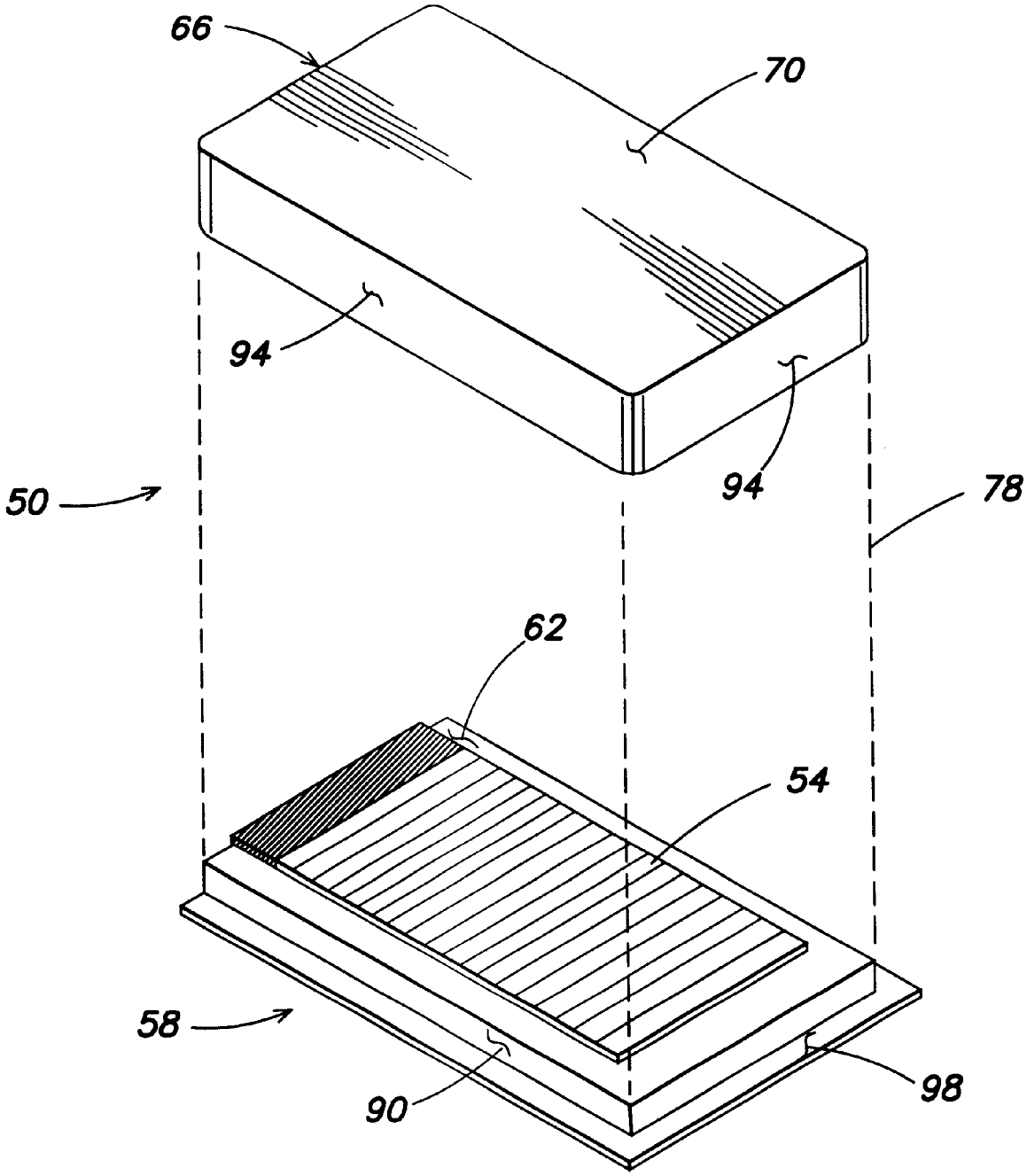
FIG. 13 is a perspective view showing yet another embodiment of a tray structure and covering structure, also showing how the tray structure and the covering structure cooperatively engage.

FIG. 1 shows an embodiment of the covering structure 66 which illustrates some principles of the invention. One of such principles is to direct water away from the notepad 54. Another of such principles is to prevent water from pooling on a top panel 70 of the covering 66. In the embodiment shown in FIG. 1, the covering structure 66 has a top panel 70 and an adjoining side panel 94 on every side of the top panel 70. The covering 66 is designed to cooperatively engage with a tray structure 58 either through a sliding connection 78 with the tray structure 58 as shown in FIG. 13 or through a pivotal connection 82 at an edge of the tray structure 58 as shown in FIG. 6. The top panel 70 of the covering structure 66 is configured at an angle such that when it sits on top of the tray structure 58, water will not be able to pool on the top panel 70. In the embodiment shown in FIG. 1, this is accomplished through an angled top panel although many other configurations could prevent water from pooling in different embodiments of the invention. In FIG. 1, the covering structure 66 is shown to have distinct edges and corners 86 although, these edges and corners 86 could be rounded, chamfered, or otherwise smoothed as well. The covering structure 66 may be produced out of any water resistant materials such as plastics, water resistant cardboard, water resistant pressboard, or metals. However, plastics are preferred for their relative light weight and the availability of colors including clear or translucent colors. FIG. 2 shows an alternate embodiment of the covering structure 66 which serves the same purpose as the covering shown in FIG. 1; however, it prevents water from pooling at its top panel 70 by having a domed structure as a top panel 70. Other embodiments may have top panels 70 with features such as troughs that accomplish the goal of preventing water from pooling on the top panel 70.

Figure 4:
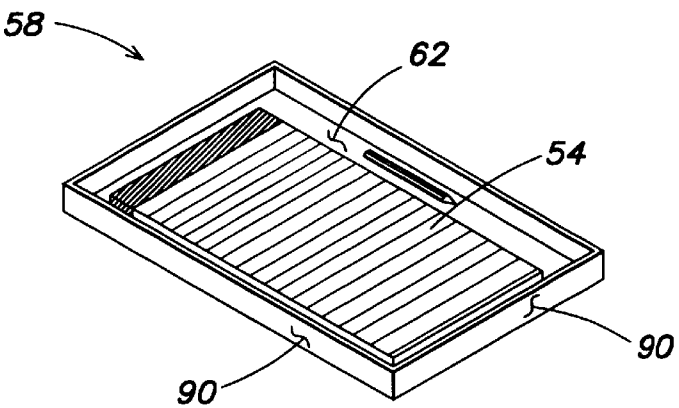
FIG. 4 is a perspective view of another embodiment of a tray structure.
Figure 3:
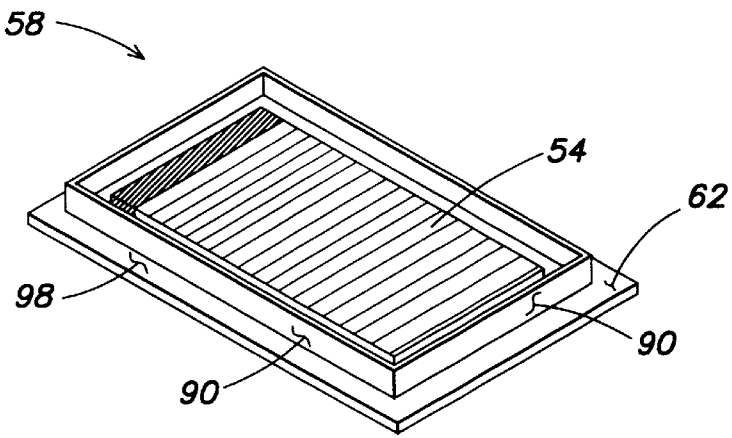
FIG. 3 is a perspective view of an embodiment of a tray structure.
Figure 5:
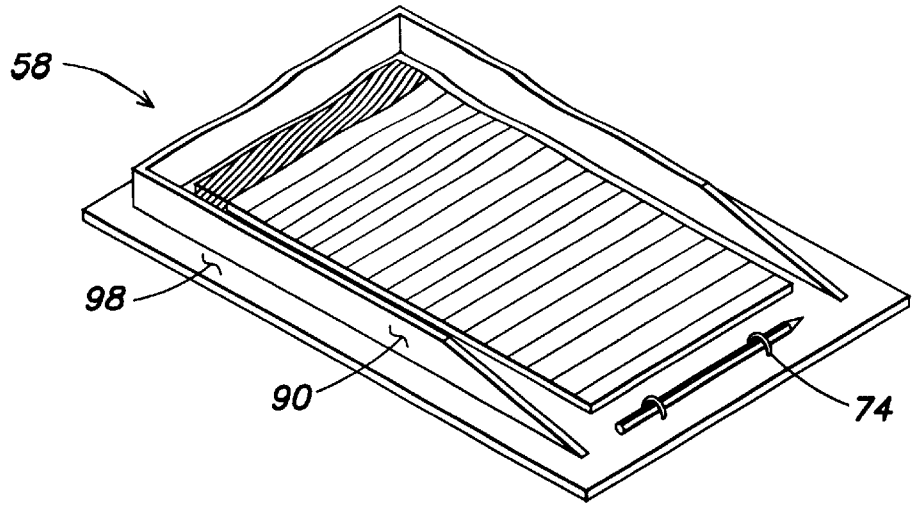
FIG. 5 is a perspective view of yet another embodiment of a tray structure.

The tray structure 58 shown in FIGS. 3, 4 and 5 all serve to hold a notepad 54 and possibly a writing utensil as well. These embodiments have a base panel 62 and a tray side panel 90. It is noted that any covering structure 66 embodiments may be used with any of the tray structure 58 embodiments. The tray structures 58 cooperatively engage with a covering structure 66 either through a sliding connection 78 or through a pivotal connection 82. The tray side panel 90 fits inside of the covering side panel 94 when the notepad holder 50 is in the closed position. This engagement structure further prevents the elements such as splashed water from entering the interior of the holder 50. The embodiments shown in FIGS. 3, 5 and 13 have the side panel 90 connected to the base panel 62 in a position that leaves a ledge 98 external to the tray side panel 90. The embodiment shown in FIG. 4 has the side panel 90 connected to the base panel 62 in a manner that does not create a ledge 98. In some embodiments, the tray side panel 90 may be shorter than the covering side panel 94. Such a shortened tray side panels 90 allows the user easier access to the notepad when it is being written on. Some embodiments may contain a side panel 90 that does not completely surround the notepad 54, such as the embodiment shown in FIG. 5 and FIG. 6. This feature allows improved access to the notepad 54 when it is being written on by allowing the user's arm to lay flat on the base panel 62. Some embodiments may also have a writing utensil retainer 74 as shown in FIG. 5. The writing utensil retainer 74 may be a clip, tether, depression or any similar feature adapted to retain a writing utensil.

As shown in FIG. 13, some embodiments may have a base panel 62 of the tray structure 58 which accepts a notepad 54 and is significantly elevated from a mounting surface 102, wherein the mounting surface 102 is the point that interfaces with a table or other structure directly below the tray structure 58. In this embodiment, the tray side panels 90 do not interfere with the user's arm when they are writing on the notepad 54. The notepad 54 is also lifted further away from the mounting surface 102 where splashed water or other elements may reside. A ledge 98 may exist adjacent to the tray side panels 90 as shown in FIG. 13; however, similar embodiments may exist without such ledges 98.

Figure 7:
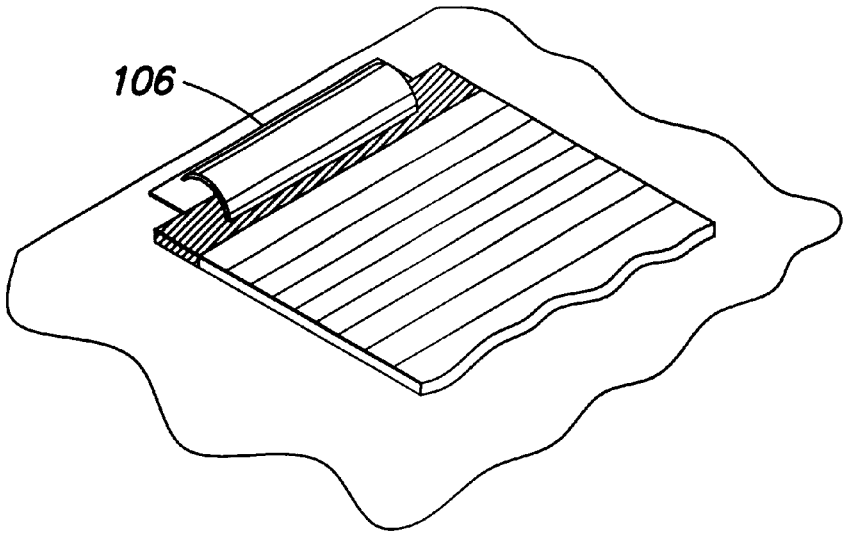
FIG. 7 is an enlarged view of another embodiment of a notepad holder.
Figure 8:
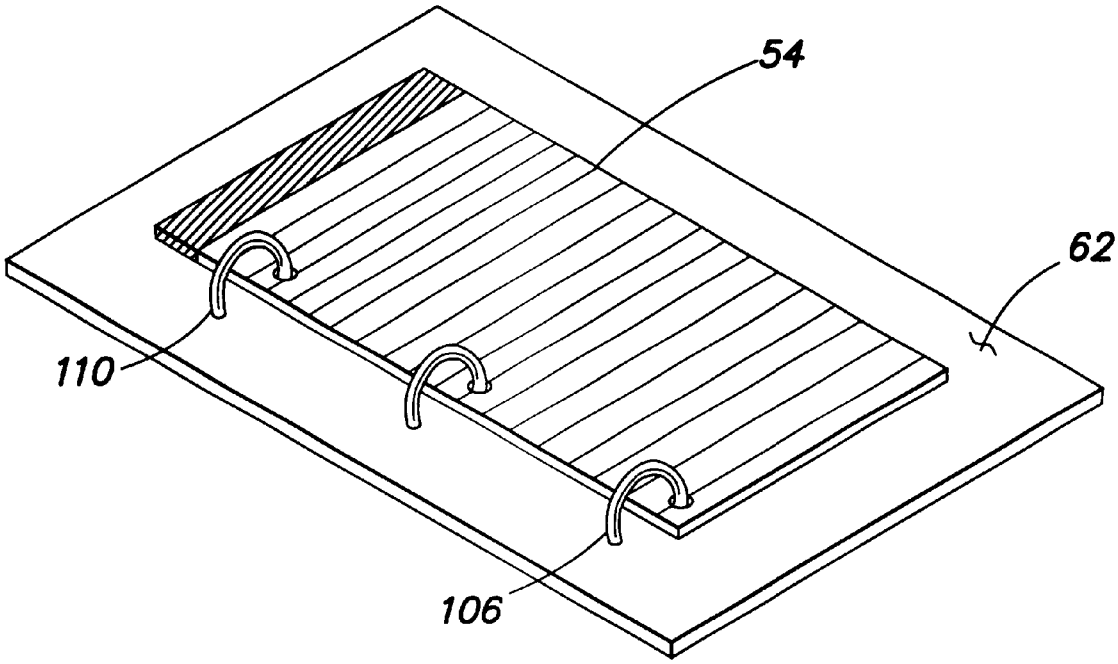
FIG. 8 is a perspective view of yet another embodiment of a notepad holder.
Figure 11:
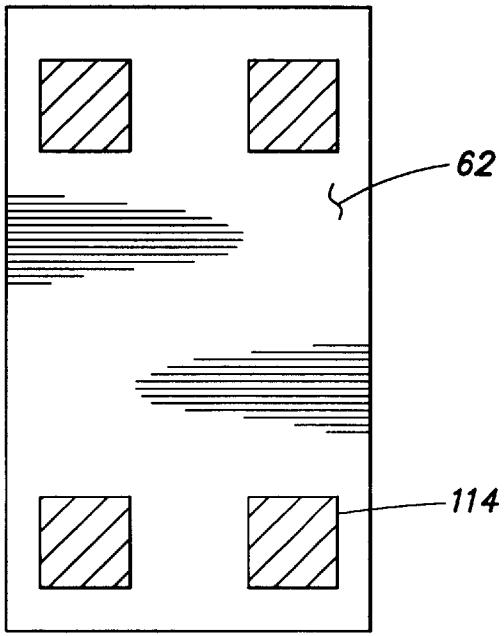
FIG. 11 is a bottom view showing another embodiment of a tool free fastener.
Figure 12:
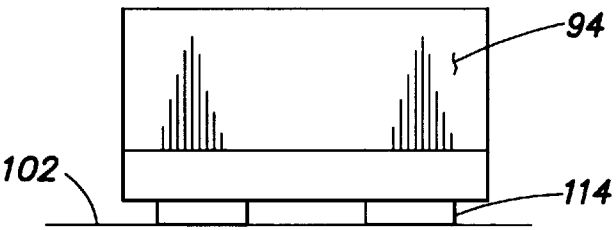
FIG. 12 is an end view showing another embodiment of a tool free fastener.

A notepad fastener 106 may also be used for securing the notepad 54 to the tray structure 58. FIG. 7 depicts a notepad fastener 106 that holds a notepad 54 through the use of a clamping force. FIG. 8 shows an embodiment of the notepad fastener 106 that uses rings 110 which pass through pre-drilled holes in the notepad 54 to perform a similar function.

Figure 9:
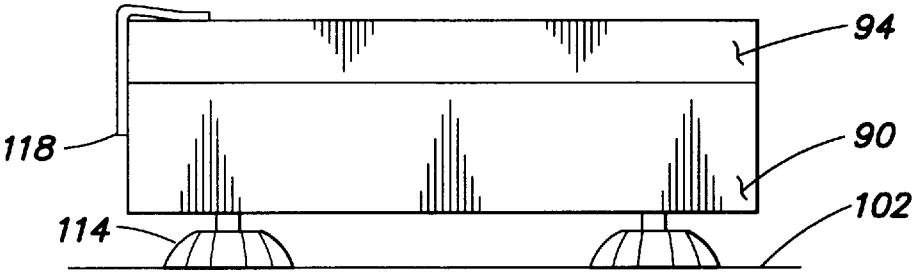
FIG. 9 is a side view showing an embodiment of a tool free fastener.
Figure 10:
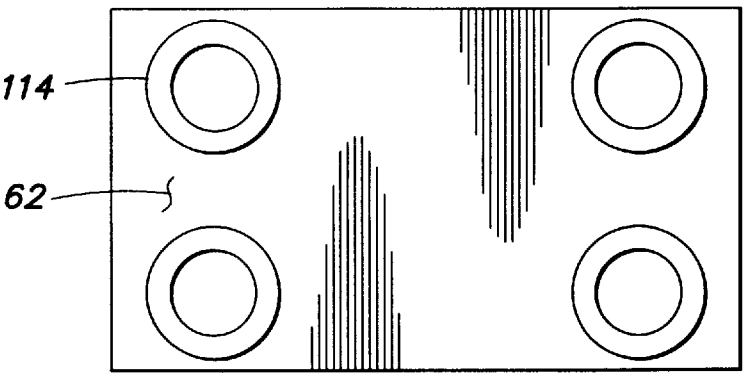
FIG. 10 is a bottom view showing an embodiment of a tool free fastener.

The tray structure 58 may also contain fasteners 114 adapted to removably hold the tray structure 58 to a mounting surface 102 as shown in FIGS. 9–12. Such fasteners 114 may include, but are not limited to tool free fasteners like suction cups, adhesive pads, magnetic pads, and hook and loop fasteners such as VELCRO. Such devices are described as being tool free which means that tools are not required to attach the tray structure 58 with the fasteners to a mounting surface 102. However, tools may be used to attach the fasteners 114 to the tray structure, such as screws, rivets, clips, adhesives, nails, etc. In some embodiments, the fasteners are attached to the base panel 62 on a side that is adjacent to the mounting surface 102, although they may also be attached to the tray structure 58 at other points. The mounting surface 102 can be whatever surface the user desires, but is generally intended to be a flat horizontal surface such as table top or similar. As shown in FIGS. 9 and 10, an embodiment may include a plurality of suction cups attached to the base panel 62 which are used to fasten the tray structure 58 to a mounting surface 102.

The protective notepad holder may also have a closure 118 adapted to selectively secure the covering structure 66 to the tray structure 58 as is shown in the various figures. The closure 118 may be comprised of a snap, a tie, a magnetic latch, interference latch, a spring loaded latch, a VELCRO (hook and loop) strap, or any other types of closures known to those skilled in the art.

While the invention has been described in conjunction with specific embodiments thereof, it is evident that many alternatives, modifications and variations will be apparent to those skilled in the art. Accordingly, embodiments of the invention as set forth herein are intended to be illustrative, not limiting. Various changes may be made without departing from the invention.

What is claimed is:

1. A notepad holder comprising:

a tray structure adapted to receive a notepad, the tray structure having a base panel, a tray side panel, and a notepad fastener to secure the notepad to the tray structure; and a covering structure having a top panel, and a covering side panel, the covering structure being completely separable from the tray structure whereby removing the covering structure gives access to the notepad and replacing the covering structure prevents splashed liquid from reaching the notepad, the covering structure being shaped to prevent water from pooling on the top panel when the covering structure is placed on the tray structure with the base panel in a horizontal position.

2. The notepad holder of claim 1 wherein the notepad fastener is attached to the base panel and secures the notepad by applying a clamping force.

3. The notepad holder of claim 1 wherein the notepad fastener is attached to the base panel and secures the notepad by passing completely through a portion of the notepad.

4. The notepad holder of claim 1 further comprising a closure adapted to removably secure the covering structure to the tray structure.

5. The notepad holder of claim 1 wherein the covering structure is adapted to engage the tray structure such that the covering side panel completely encloses the tray side panel.

6. The notepad holder of claim 1 further comprising a utensil retainer for removably retaining a writing utensil to the tray structure.

7. A notepad holder comprising:

a tray structure having a tray side panel, the tray adapted to securely hold a notepad;

a covering structure having a covering side panel substantially taller than the tray side panel, the covering structure adapted to mate with the tray structure to fully enclose the notepad within the tray structure and the covering structure; and a tool free fastener adapted to removably fasten the tray structure to a mounting surface.

8. The notepad holder of claim 7 wherein the tool free fastener is comprised of a suction cup.

9. The notepad holder of claim 7 wherein the covering structure is completely separable from the tray structure whereby removing the covering structure allows access to the notepad and replacing the covering structure prevents splashed liquid reaching the notepad and prevents access to the notepad.

10. The notepad holder of claim 7 wherein the covering structure is pivotally connected to the tray structure whereby pivoting the covering structure to an open position allows access to the notepad and pivoting the covering structure to a closed position prevents splashed liquid reading the notepad and prevents access to the notepad.

11. The notepad holder of claim 10 wherein the covering structure is pivotally connected to the tray structure at a top edge of the tray structure.

12. The notepad holder of claim 7 wherein the tray structure includes a notepad fastener to secure the notepad to the tray structure.

13. The notepad holder of claim 12 wherein the notepad fastener is attached to the base panel and secures the notepad by applying a clamping force.

14. The notepad holder of claim 12 wherein the notepad fastener is attached to the base panel and secures the notepad by passing completely through a portion of the notepad.

15. The notepad holder of claim 7 further comprising a closure adapted to selectively secure the covering structure to the tray structure.

16. A notepad holder comprising:

a tray structure having a notepad fastener adapted to securely hold a notepad to the tray structure;

a covering structure adapted to mate with the tray structure to fully enclose the notepad within the tray structure and the covering structure; and a tool free fastener adapted to removably fasten the tray structure to a mounting surface.

17. The notepad holder of claim 16 wherein the tool free fastener is comprised of a suction cup.

18. The notepad holder of claim 16 wherein the covering structure is completely separable from the tray structure whereby removing the covering structure allows access to the notepad and replacing the covering structure prevents splashed liquid reaching the notepad and prevents access to the notepad.

19. The notepad holder of claim 16 wherein the covering structure is pivotally connected to the tray structure whereby pivoting the covering structure to an open position allows access to the notepad and pivoting the covering structure to a closed position prevents splashed liquid reading the notepad and prevents access to the notepad.

20. The notepad holder of claim 19 wherein the covering structure is pivotally connected to the tray structure at a top edge of the tray structure.

21. The notepad holder of claim 16 wherein the notepad fastener is attached to the base panel and secures the notepad by applying a clamping force.

22. The notepad holder of claim 16 wherein the notepad fastener is attached to the base panel and secures the notepad by passing completely through a portion of the notepad.

23. The notepad holder of claim 16 further comprising a closure adapted to selectively secure the covering structure to the tray structure.

* * * * *